US007659799B2

(12) United States Patent
Jun et al.

(10) Patent No.: US 7,659,799 B2
(45) Date of Patent: Feb. 9, 2010

(54) DIELECTRIC WAVEGUIDE FILTER WITH CROSS-COUPLING

(75) Inventors: Dong Suk Jun, Daejeon (KR); Kyoung Ik Cho, Daejeon (KR); Hong Yeol Lee, Chungcheongbuk-do (KR); Dong Young Kim, Daejeon (KR); Sang Seok Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 266 days.

(21) Appl. No.: 11/588,176

(22) Filed: Oct. 25, 2006

(65) Prior Publication Data

US 2007/0120628 A1 May 31, 2007

(30) Foreign Application Priority Data

Nov. 25, 2005 (KR) ..... 10-2005-0113486

(51) Int. Cl.
*H01P 1/208* (2006.01)

(52) U.S. Cl. ..... 333/212; 333/230

(58) Field of Classification Search ..... 333/208, 333/210, 212, 202, 239, 230
See application file for complete search history.

(56) References Cited

U.S. PATENT DOCUMENTS 5,821,836 A * 10/1998 Katehi et al. ..... 333/202
6,057,747 A 5/2000 Takenoshita et al.
6,535,083 B1 3/2003 Hageman et al.
2004/0085151 A1* 5/2004 Fukunaga ..... 333/26
2004/0155732 A1* 8/2004 Fukunaga ..... 333/212
2005/0156688 A1* 7/2005 Ito et al. ..... 333/208

FOREIGN PATENT DOCUMENTS

JP 2005-269012 9/2005
JP 2005-318360 11/2005
KR 10-2005-0043554 5/2005
KR 10-2005-0059764 6/2005

OTHER PUBLICATIONS

"A V-band Planar Narrow Bandpass Filter Using a New Type Integrated Waveguide Transition" by Sung Tae Choi, et al.; *IEEE Microwave and Wireless Components Letters*; vol. 14, No. 12, Dec. 2004; pp. 545-547.
"A 60-GHz-Band Planar Dielectric Waveguide Filter for Flip-Chip Modules" by Masaharu Ito, et al.; *IEEE Transactions on Microwave Theory and Techniques*; vol. 49, No. 12, Dec. 2001; pp. 2431-2436.

* cited by examiner

*Primary Examiner*—Benny Lee
*Assistant Examiner*—Gerald Stevens
(74) *Attorney, Agent, or Firm*—Blakely, Sokoloff, Taylor & Zafman LLP

(57) ABSTRACT

Provided is a dielectric waveguide filter. The filter includes: a multi-layered structure of dielectric substrates having first and second ground planes at its top and bottom; first, second, and third waveguide resonators disposed at multiple layers within the multi-layered structure; converters for signal transition between input/output ports and the first and third waveguide resonators; first vias for forming the first, second, and third waveguide resonators; and second vias disposed at a boundary surface of the first waveguide resonator and the third waveguide resonator.

10 Claims, 14 Drawing Sheets

DIELECTRIC WAVEGUIDE FILTER WITH CROSS-COUPLING

CROSS-REFERENCE TO RELATED APPLICATION

This application claims priority to and the benefit of Korean Patent Application No. 2005-113486, filed Nov. 25, 2005, the disclosure of which is incorporated herein by reference in its entirety.

BACKGROUND

1. Field of the Invention

The present invention relates to a dielectric waveguide filter with cross-coupling and a multi-layered resonator structure within multiple layers using a via and a pattern, and more particularly, to a dielectric waveguide filter used in a millimeterwave radio frequency (RF) front-end module of a 60 GHz pico cell communication system.

2. Discussion of Related Art

Wireless communication systems are expected to develop from a second generation wireless communication system for voice and character transmission to a third generation wireless communication system of an International mobile telecommunication-2000 (IMT-2000) for image information transmission and to a fourth generation wireless communication system with a transfer rate of 100 Mbps or more. Such a fourth generation broadband wireless communication system is expected to use a millimeterwave, not a conventional frequency band that is already in a saturation state.

In the development of the millimeterwave wireless communication system, the most significant concerns are miniaturization and low price. In the development of the conventional wireless communication system, one of factors making it most difficult to achieve the miniaturization and the low price is just a filter. In particular, a waveguide filter occupies a basic area depending on a frequency in air, and should use flange or transition of a variety of formats depending on a transmission format of input/output.

Accordingly, the conventional waveguide filter has a drawback in that an occupation area is considerably great in the whole wireless communication system, and a high cost is required for device manufacture.

As a prior art for solving the conventional drawbacks, U.S. Pat. No. 6,535,083 discloses "EMBEDDED RIDGE WAVEGUIDE FILTERS." In the U.S. Pat. No. 6,535,083, as shown in FIG. 1, both sidewalls of a dielectric waveguide resonator are implemented using each one line of vias 20 disposed in multi-layered dielectric layers 11, 13, and 14 and ground planes 10 and 12 on a top and a bottom of the dielectric layers. Ridge waveguide portions $\mathbf{16}_1$, $\mathbf{16}_2$, and $\mathbf{16}_3$ are implemented using vias 18 and patterns $\mathbf{30}_1$, $\mathbf{30}_2$, $\mathbf{30}_3$, $\mathbf{32}_1$, $\mathbf{32}_2$, and $\mathbf{32}_3$. Further, input/output ports 22 and 24 of strip lines 26 and 28 connected to a conductor by coupling units 27 and 29 through the pattern are implemented on low temperature cofired ceramic (LTCC), high temperature cofired ceramic (HTCC), and print wired board (PWB) substrates.

However, the U.S. Pat. No. 6,535,083 has a drawback of being improper to a present process in which the vias should be maintained at predetermined intervals according to a design rule, and has a drawback of being incapable of controlling a height of a dielectric waveguide as desired, and has a drawback in that another transition should be necessarily used for connection with and measurement of other external devices since input/output lines should be within a multi-layered substrate.

Further, as another prior art for solving the conventional drawbacks, there is an article entitled "A V-band Planar Narrow Bandpass Filter Using a New Type Integrated Waveguide Transition", announced in IEEE Microwave and Wireless Components letter on December 2004 by Sung Tae Choi. As shown in FIG. 2A, the article discloses a dielectric waveguide filter for a small size, a low insertion loss, and broadband spurious suppression. Further, on a two-dimension plane are implemented Grounded CoPlanar Waveguide (GCPW) input/output ports, an impedance matching portion, a T-type waveguide-GCPW signal converter, and a dielectric waveguide resonator. However, the conventional art has a drawback of being incapable of implementing an attenuation pole for removing an image wave at a top or bottom of a pass band.

Further, as yet another prior art for solving the conventional drawbacks, there is an article entitled "60 GHz band Dielectric Waveguide Filters with Cross-coupling for Flip chip Modules" announced in IEEE-S Digest, p 1789-1792 on June 2002 by Masaharu Ito. As shown in FIG. 2B, the article discloses a cross-coupling dielectric waveguide filter for a small size, a low insertion loss, and broadband spurious suppression, and with an attenuation pole for removing an image wave at a top of a pass band. On a two-dimension plane are embodied CoPlanar Waveguide (CPW) input/output ports, a U-type waveguide-CPW signal converter, and a dielectric waveguide resonator. However, the prior art has a drawback of being difficult to implement cross-coupling for removing the image wave at the bottom of the pass band.

SUMMARY OF THE INVENTION

The present invention is directed to implementation of a dielectric waveguide filter having a multi-layered resonator structure within multiple layers using a via and a pattern, having an asymmetric frequency characteristic, and having a cross-coupling resonator.

The present invention is also directed to implementation of a dielectric resonator filter, which can be manufactured without using a precise patterning process, and thereby the manufacture process can be simplified and a cost of mass production can be lowered.

The present invention is also directed to implementation of a dielectric resonator filter, which is used in a millimeterwave RF front-end module or a system on package (SOP) module of a 60 GHz pico cell communication system.

One aspect of the present invention is to provide a dielectric waveguide filter including: a multi-layered structure of dielectric substrates having first and second ground planes at its top and bottom; first, second, and third waveguide resonators disposed at multiple layers within the multi-layered structure; converters for signal transition between input/output ports and the first and third waveguide resonators; first vias for forming the first, second, and third waveguide resonators; and second vias disposed at a boundary surface of the first waveguide resonator and the third waveguide resonator.

The first and second waveguide resonators and the second and third waveguide resonators may be coupled using slots.

Some of the first vias may connect the first ground plane with the second ground plane. An interval between the first vias may be selected to suppress a radiation loss and a broadband spurious. The second vias may be arranged to form an attenuation pole for removing an image wave at a top of a pass band. The first and second vias may have the same diameter.

The converter may perform the signal transition from a TEM (Transverse ElectroMagnetic) mode to a $TE_{10}$ (transverse electric) mode.

The input/output ports may comprise at least one transmission line of a microstrip line, a stripline, and a coplanar waveguide.

The filter may further include third vias for controlling coupling between the input/output ports and the first and third waveguide resonators.

The filter may further include other vias disposed around the input/output ports for cutting off other unwanted waveguide modes.

The filter may further include a ground pattern disposed around the input/output ports for cutting off unwanted other waveguide modes.

Another aspect of the present invention is to provide a filter further including a metallized pattern disposed at a boundary surface of the first and third waveguide resonators.

The second vias and the metallized pattern may be arranged to form the attenuation pole for removing the image wave at the top or bottom of the pass band.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF PREFERRED EMBODIMENTS

Figure 1:
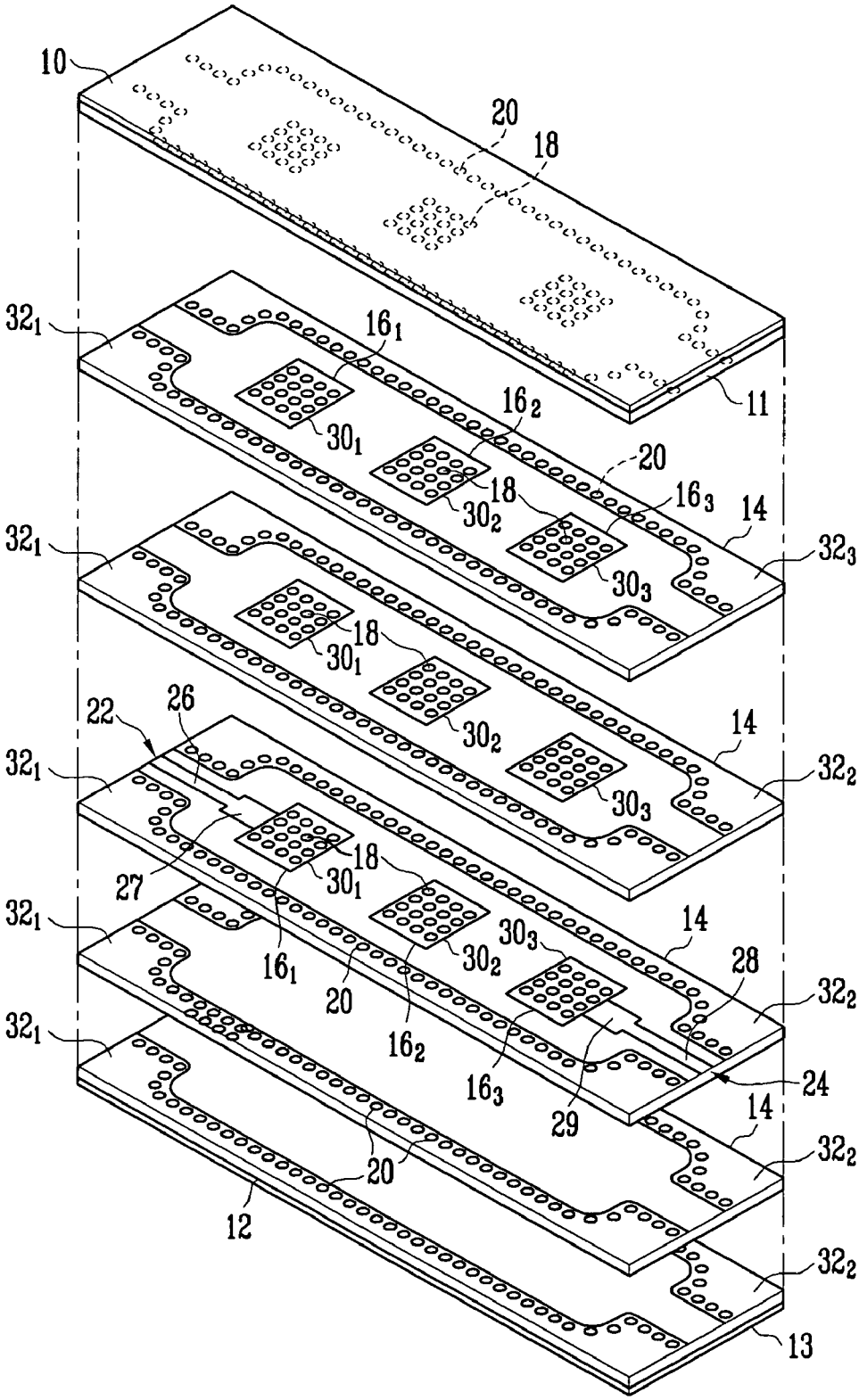
FIG. 1 (PRIOR ART)
FIG. 1 illustrates the construction of a conventional embedded ridge waveguide filter.
Figure 2A:
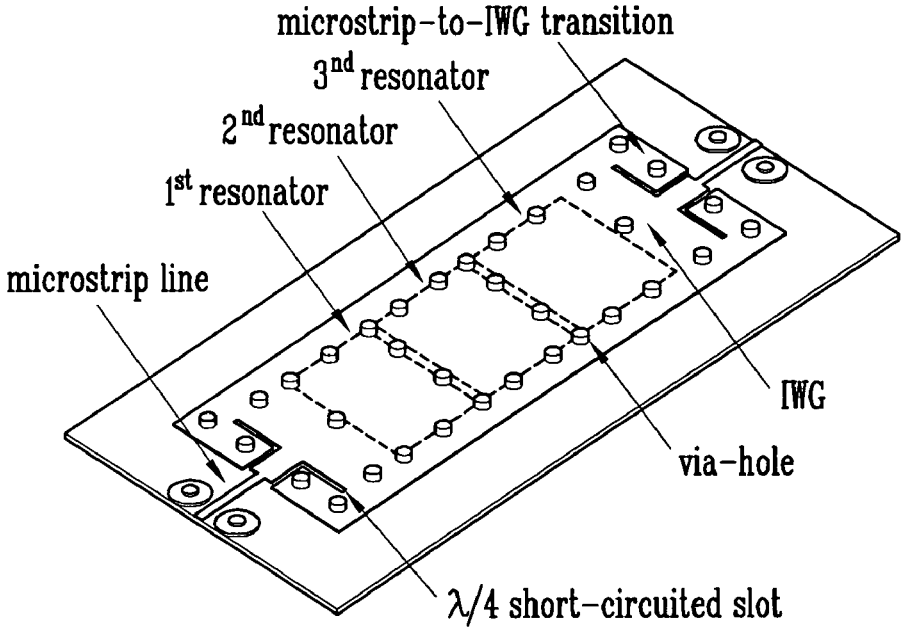
FIG. 2A (PRIOR ART)
FIG. 2A illustrates the construction of a conventional V-band planar narrow bandpass filter.
Figure 2B:
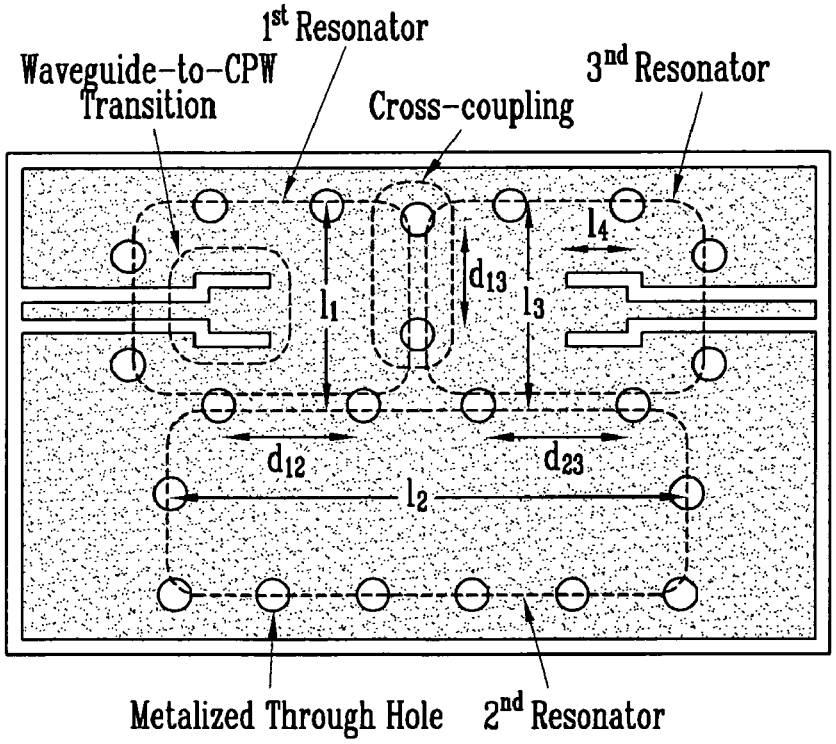
FIG. 2B (PRIOR ART)
FIG. 2B illustrates the construction of a conventional 60 GHz band dielectric waveguide filter with cross-coupling.

Hereinafter, an exemplary embodiment of the present invention will be described in detail. In the following description, when one layer will be described as being on the other, it may exist directly on the other layer or a third layer may be also interposed therebetween. In the drawings, a dielectric waveguide filter and each of its constitutional components are wholly or partially projected and illustrated to clearly show constructions of a via and a pattern filled with a conductor. Further, in the drawings, each layer can be exaggerated in thickness and size for description convenience and clarity, and the same symbol indicates like or same component.

Figure 3:
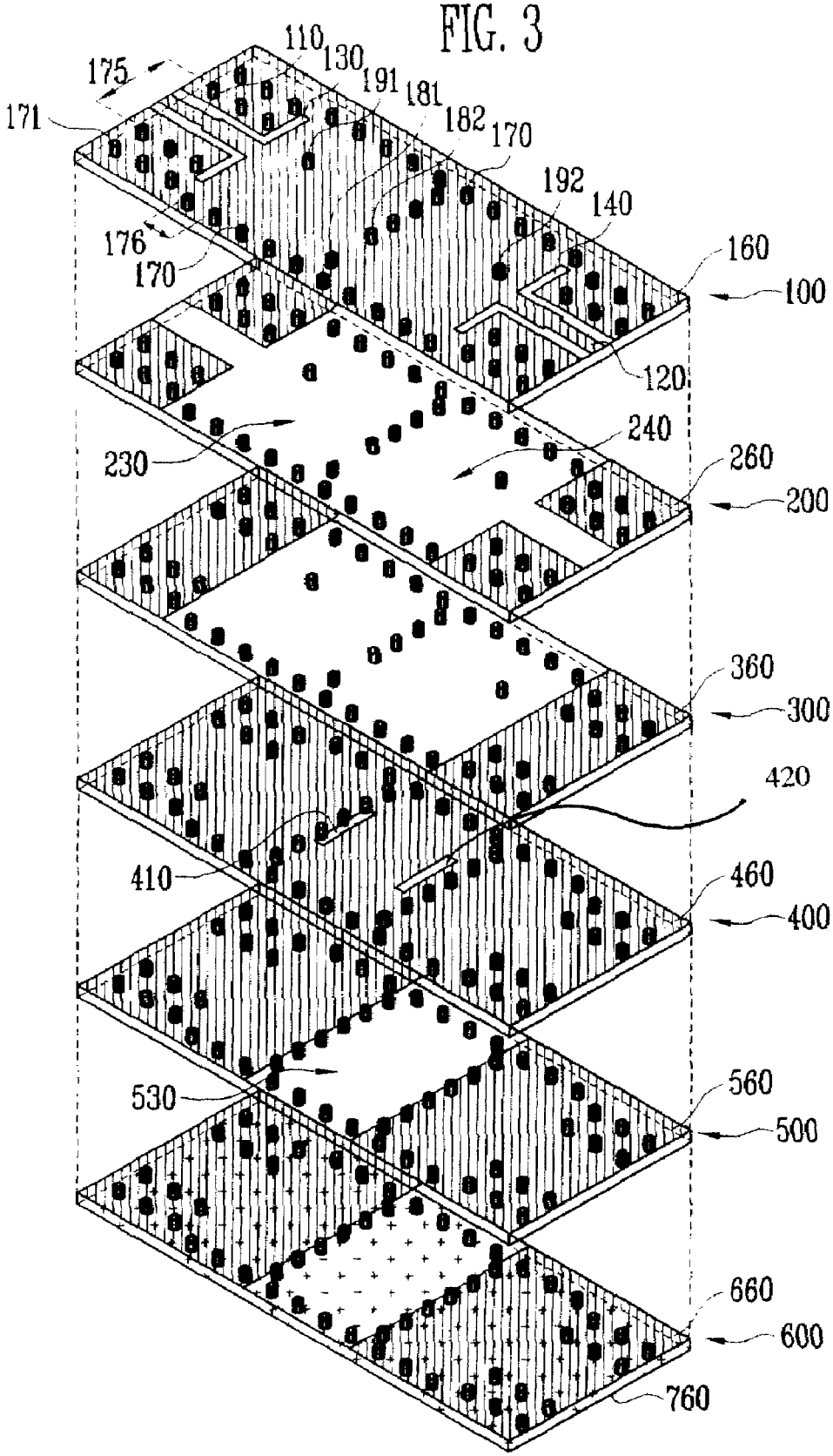
FIG. 3 illustrates the construction of a dielectric waveguide filter with cross-coupling according to the first embodiment of the present invention.

FIG. 3 is a perspective view illustrating a construction of a dielectric waveguide filter with cross-coupling according to the first embodiment of the present invention.

Referring to FIG. 3, the inventive dielectric waveguide filter includes a first ground plane 160 and a second ground plane 760 at its top and bottom and a dielectric substrate with a multi-layered structure between the two ground planes 160 and 760. The dielectric waveguide filter further includes an input port 110 and an output port 120 (hereinafter, referred to as "input/output ports") for connection with external systems and other devices; converters 130 and 140 for signal transition from a Transverse ElectroMagnetic (TEM) mode to a transverse electric $(TE)_{10}$ mode; dielectric waveguide resonators 230, 240, and 530 providing a desired characteristic of the filter; vias 170 for forming each of dielectric waveguide resonators 230, 240, and 530; vias 171 for removing an unwanted waveguide mode; vias 181 and 182 for cross-coupling between the dielectric waveguide resonators 230 and 240 disposed on the same layer; vias 191 and 192 for controlling coupling between the input/output ports 110 and 120 and the two dielectric waveguide resonators 230 and 240; and patterns 410 and 420 for electric-field coupling between the dielectric waveguide resonators 230 and 530, and 240 and 530 disposed on different layers.

The converters 130 and 140 transit the signal from the input port 110 to the first dielectric waveguide resonator 230 or from the third dielectric waveguide resonator 240 to the output port 120. The input/output ports 110 and 120 can be various transmission lines such as a microstripline, a stripline, and a CoPlanar Waveguide (CPW). Accordingly, the converters 130 and 140 may need to be changed a little.

The converters 130 and 140 are disposed to be connected to both sides of the top ground plane 160, respectively, and are properly controlled in width and length, thereby providing impedance matching between the input/output ports 110 and 120 and the dielectric waveguide resonators 230 and 240, and facilitating signal transition between both devices.

The vias 170 for forming the dielectric waveguide resonators 230, 240, and 530 connect the first ground plane 160 with the second ground plane 760. An interval 176 between centers of the vias 170 is designed depending on a desired frequency band so that, when a signal is transmitted, a radiation loss and a broadband spurious can be suppressed. Further, the vias 170 form both sidewalls of the dielectric waveguide resonators 230, 240, and 530, and are designed at predetermined intervals from the vias 191 and 192 inserted into the dielectric waveguide resonator, thereby obtaining a desired frequency characteristic. The vias 181 and 182 for controlling the cross-coupling are arranged at a predetermined interval depending on a desired frequency band to form an attenuation pole for removing an image wave at a top of a pass band. An interval 175 between centers of the vias 171 for removing unwanted other waveguide modes is also designed depending on a desired frequency band. It is desirable that the vias 170, 171, 181, 182, 191, and 192 have the same size/diameter. In this case, the simplified pattern can simplify a manufacture process and improve productivity.

In manufacturing the dielectric waveguide filter according to an embodiment of the present invention, when a distance between the vias is three times or less the diameter of the via in a low temperature cofired ceramics (LTCC) process, a crack between the vias occurs. This obstructs densely placing the vias to cut off the other unwanted waveguide modes. Accordingly, in the present invention, in order to overcome this problem while cutting off the other unwanted waveguide modes using the via 171, the unwanted waveguide mode is cut off using an interval and a ground pattern of the vias 171 located around the input/output ports 110 and 120.

In order to design the inventive dielectric waveguide filter using a LTCC substrate having permittivity of 5.8, a total size of a dielectric waveguide designed in air should be constantly reduced at a rate of $1/\sqrt{\epsilon_r}$ on all X, Y, and Z axes as the permittivity changes as in Equation 1 below:

$$\lambda_g=2\pi/\beta=2\pi\sqrt{k^2-K_c^2} \quad \text{[Equation 1]}$$

where, $\lambda_g$: wavelength of dielectric waveguide, $\beta$: propagation constant, k: wave number of substance, and $K_c$: cut-off wave number.

In Equation 1, $k=\sqrt{\mu\epsilon}$, $K_c=\sqrt{(m\pi/a)^2+(n\pi/b)^2}$, and $k>>K_c$ at a high frequency of a millimeter band. Therefore, it can be seen through simplification that $\lambda_g$ is inversely proportional to $\sqrt{\epsilon_r}$.

Figure 4A:
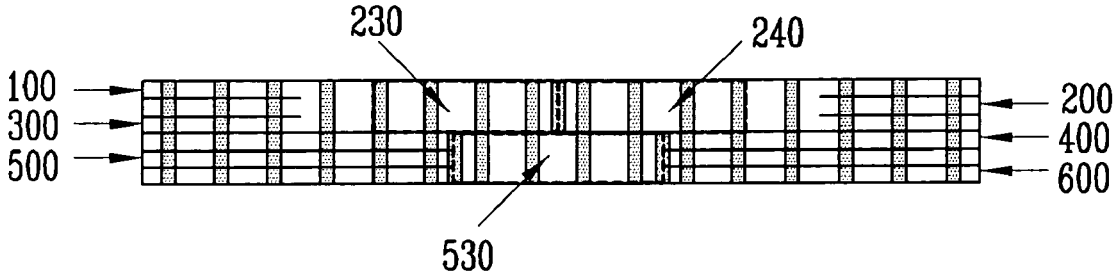
FIG. 4A is a front view illustrating the dielectric waveguide filter of FIG. 3.
Figure 4B:
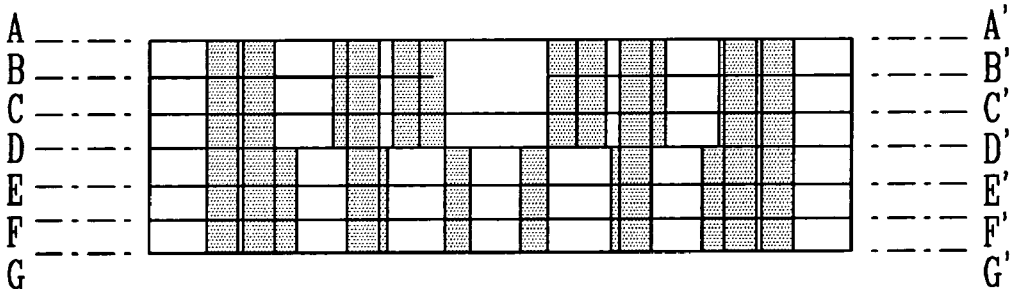
FIG. 4B is a side view illustrating the dielectric waveguide filter of FIG. 3.

FIGS. 4A and 4B are a front view and a side view illustrating the dielectric waveguide filter of FIG. 3.

As shown in FIG. 4A, the inventive dielectric waveguide filter includes multi-layered structures 100, 200, 300, 400, 500, and 600, and is designed to have a shape of substantially rectangular parallelepiped. In the dielectric waveguide filter, the first dielectric waveguide resonator 230 and the third dielectric waveguide resonator 240 are located on the same layer and are cross-coupled through the via not to be adjacent to each other. The first and second dielectric waveguide resonators 230 and 530 and the second and third dielectric waveguide resonators 530 and 240 are located on different layers and are electric-field coupled to be up/down adjacent to each other.

The above-described dielectric waveguide filter is a filter using the $TE_{10}$ mode, and keeps the same performance even though the waveguide is reduced in height. This makes it possible to flexibly implement the height of the waveguide depending on a desired number of the dielectric substrates in the structure of the dielectric waveguide filter according to the present invention. Accordingly, a total size can be notably reduced. However, as the dielectric waveguide is decreased in height, a propagation loss is increased little by little. Therefore, it is desirable to suitably control the height depending on desired performance. In order to reduce the total size, it is desirable to dispose the ground planes at the top and bottom of the multi-layered dielectric substrate.

Meanwhile, in an embodiment of the present invention, the LTCC substrate has been exemplified as the dielectric substance used to implement the dielectric waveguide resonators 230, 240, and 530, different types of dielectric substances may be used. Further, it is desirable that the vias 170 are arranged in line to form the both sidewalls of the dielectric waveguide. Here, it is desirable to arrange many vias by making the interval between the vias 170 to be narrow, if possible. However, it is desirable to dispose the vias as densely as possible according to a rule of a process design by considering an endurance limitation of the substrate.

As shown in FIG. 4B, in the inventive dielectric waveguide filter, the pattern or ground plane constituting the filter is formed on the dielectric substrate of each layer (A-A', B-B', C-C', D-D', E-E', F-F', and G-G'). Each layer has a thickness of 0.1 mm, and the filter is constituted of six layers. Each layer has the vias, and the vias are filled with the conductor.

While the structure having the six stacked dielectric substrates is shown in FIG. 4B, the present invention is not limited to such a structure and a designer can arbitrarily select the desired number of the substrates.

FIGS. 5A to 5F are perspective views illustrating the respective layers of the dielectric waveguide filter of FIG. 3.

Figure 5A:
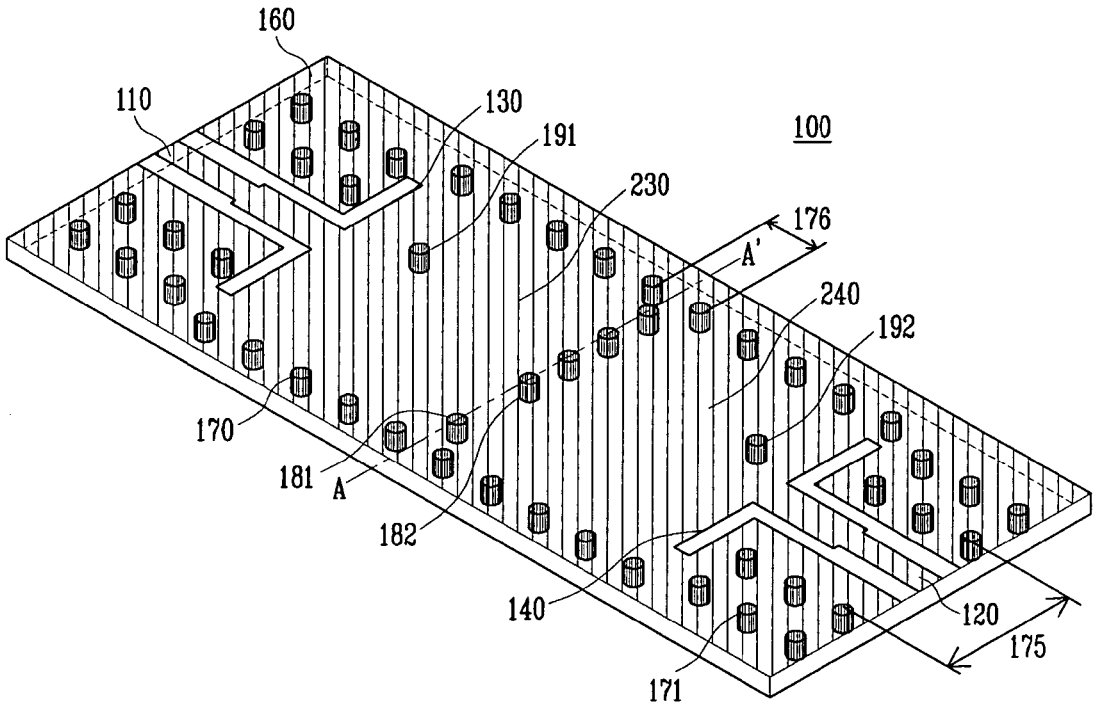
FIG. 5A is a perspective view illustrating a layer of A-A' of the dielectric waveguide filter of FIG. 3.

Referring to FIG. 5A, the input/output ports 110 and 120 for connecting the external systems and devices; the converters 130 and 140 for transiting the signal from the TEM mode to the $TE_{10}$ mode using a Grounded CoPlanar Waveguide (GCPW); the A-A' layer vias 170 for forming the dielectric waveguide and connecting top and bottom grounds; the vias 181 and 182 for controlling a boundary surface between the two dielectric waveguide resonators 230 and 240 and cross-coupling between the resonators 230 and 240; the vias 191 and 192 for controlling coupling between the input/output ports 110 and 120 and the two dielectric waveguide resonators 230 and 240; and the vias 171 for cutting off the unwanted other waveguide modes are formed on the A-A' layer 100 of the dielectric waveguide filter.

Figure 5B:
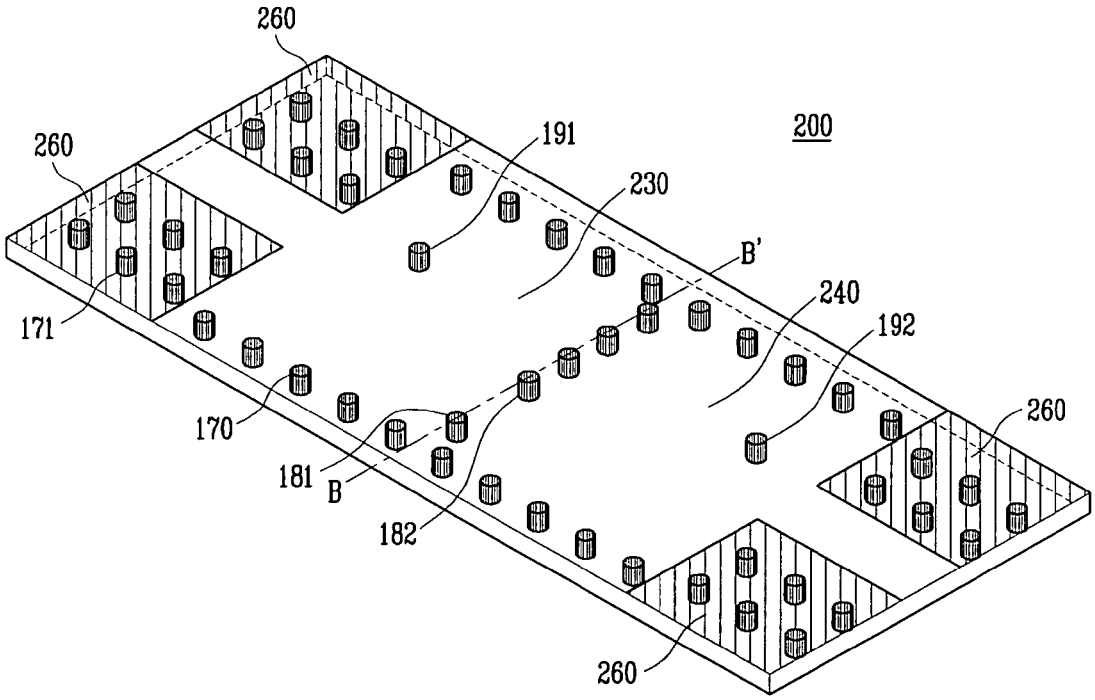
FIG. 5B is a perspective view illustrating a layer of B-B' of the dielecric waveguide filter of FIG. 3.
Figure 5C:
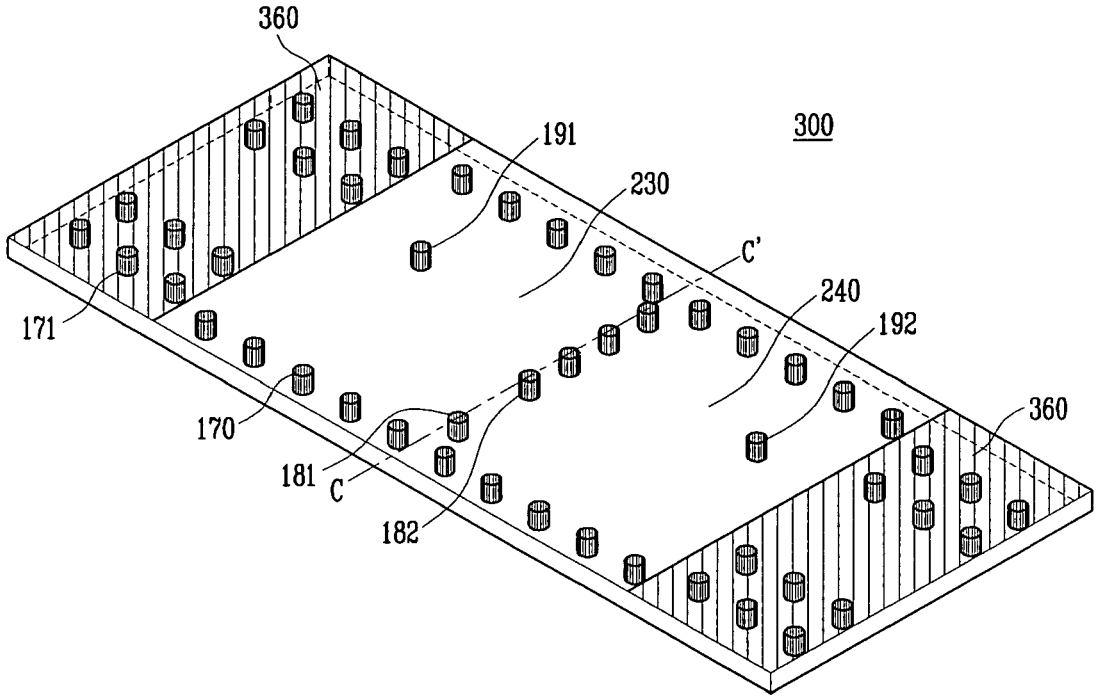
FIG. 5C is a perspective view illustrating a layer of C-C' of the dielectric waveguide filter of FIG. 3.
Figure 5D:
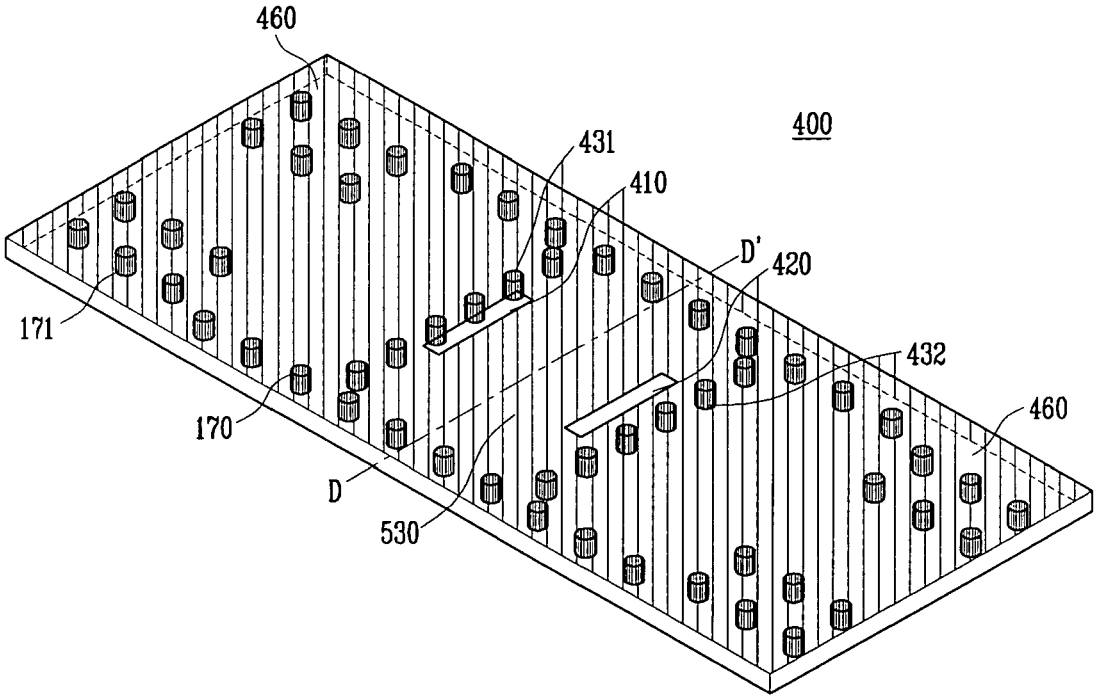
FIG. 5D is a perspective view illustrating a layer of D-D' of the dielectric waveguide filter of FIG. 3.
Figure 5E:
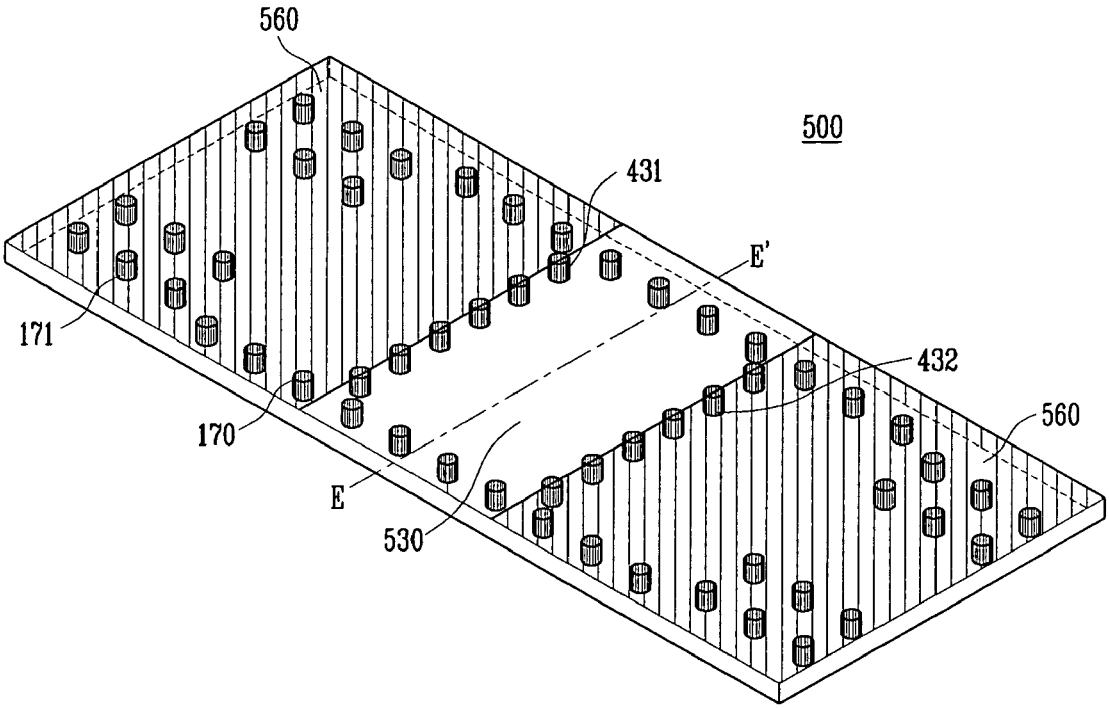
FIG. 5E is a perspective view illustrating a layer of E-E' of the dielectric waveguide filter of FIG. 3.
Figure 5F:
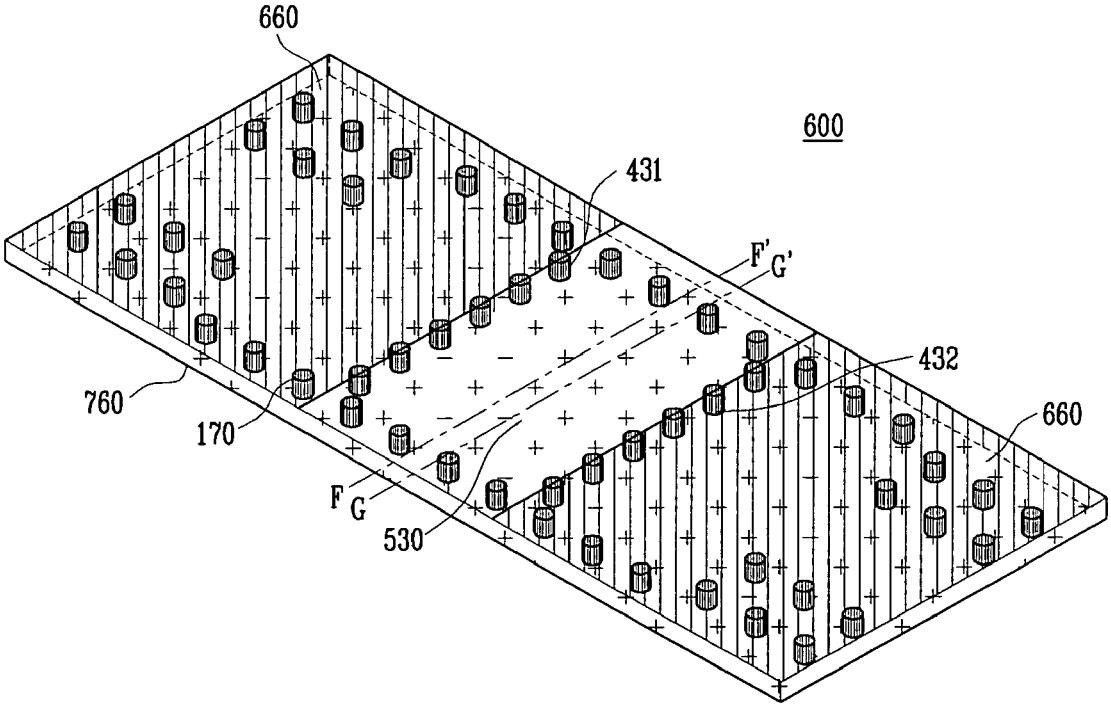
FIG. 5F is a perspective view illustrating a layer of F-F' of the dielectric waveguide filter of FIG. 3.

In the above construction, the vias 170 are sequentially employed, thereby forming the dielectric waveguide resonators 230 and 240, and the vias 170 are filled with the conductor, thereby forming a structure in which the ground plane 160 of the A-A' layer 100 is connected with a ground plane of the G-G' layer (See 760 of FIG. 5F).

The two-lined vias 170 for forming the both sidewalls of the two dielectric waveguide resonators 230 and 240 extend to the input/output ports 110 and 120. This acts to prevent the signal flowing through the dielectric waveguide resonators 230 and 240 and the converters 130 and 140 from being leaked out through the dielectric substrate. This construction can reduce the radiation loss and in turn reduce an insertion loss. Further, the vias 171 are located around the input/output ports 110 and 120 to function to cut off the unwanted other waveguide modes. This can reduce interferences of other waveguide modes and in turn reduce the insertion loss.

Referring to FIG. 5B, a B-B' layer ground plane 260; dielectric waveguide resonators 230 and 240; B-B' layer vias 170 for forming a dielectric waveguide and connecting the top and bottom grounds; B-B' layer vias 181 and 182 for controlling a boundary surface between two dielectric waveguide resonators 230 and 240 and cross-coupling between the resonators 230 and 240; B-B' layer vias 191 and 192 for controlling coupling between the input/output ports 110 and 120 and the two dielectric waveguide resonators 230 and 240; and vias 171 for cutting off the unwanted other waveguide modes are formed on the B-B' layer 200 of the dielectric waveguide filter.

The B-B' layer ground plane 260 functions as a pattern for cutting off the unwanted other waveguide modes together with the vias located around the input/output ports 110 and 120. Similarly with the A-A' layer, the vias 170 are sequentially employed, thereby forming the dielectric waveguide resonator structure, and the vias 170 are filled with the conductor, thereby forming a structure in which the B-B' layer ground plane 260 is connected with the G-G' layer ground plane.

Referring to FIG. 5C, a C-C' layer ground plane 360; dielectric waveguide resonators 230 and 240; C-C' layer vias 170 for forming a dielectric waveguide and connecting the top and bottom grounds; C-C' layer vias 181 and 182 for controlling a boundary surface between two dielectric waveguide resonators 230 and 240 and cross-coupling between the resonators 230 and 240; C-C' layer vias 191 and 192 for controlling coupling between the input/output ports 110 and 120 and the two dielectric waveguide resonators 230 and 240; and vias 171 for cutting off the unwanted other waveguide modes are formed on the C-C' layer 300 of the dielectric waveguide filter. Similarly with the B-B' layer, the vias 170 are sequentially employed, thereby forming a dielectric waveguide resonator structure, and the vias 170 are filled with the conductor, thereby forming a structure in which the C-C' layer ground plane 360 is connected with the G-G' layer ground plane.

Referring to FIG. 5D, a D-D' layer ground plane 460; D-D' layer vias 170, 431, and 432 for forming a dielectric waveguide; vias 171 for cutting off the unwanted other waveguide modes; and patterns 410 and 420 disposed at different layers for controlling the coupling between the adjacent resonators (electric-field coupled with each other) are formed on the D-D' layer 400 of the dielectric waveguide filter. The patterns 410 and 420 are designed to have slot shapes, and the vias 170 also function to connect the top ground with the bottom ground.

Referring to FIG. 5E, an E-E' layer ground plane 560; E-E' layer vias 170, 431, and 432 for forming a dielectric waveguide; vias 171 for cutting off the unwanted other waveguide modes; and the dielectric waveguide resonator 530 are formed on the E-E' layer 500 of the dielectric waveguide filter. The dielectric waveguide resonator 530 is electric-field coupled with two other resonators 230 and 240 through the patterns 410 and 420 of FIG. 5D, and also functions to connect the top ground with the bottom ground.

Referring to FIG. 5F, an F-F' ground plane 660; a G-G' layer ground plane 760 facing the F-F' layer; F-F' layer vias 170, 431, and 432 for forming a dielectric waveguide; vias 171 for cutting off unwanted other waveguide modes; and the dielectric waveguide resonator 530 are formed on the F-F' layer 600 of the dielectric waveguide filter. The G-G' layer ground plane 760 is connected with the A-A' layer ground plane 160 of FIG. 5A through the via 170.

Figure 6:
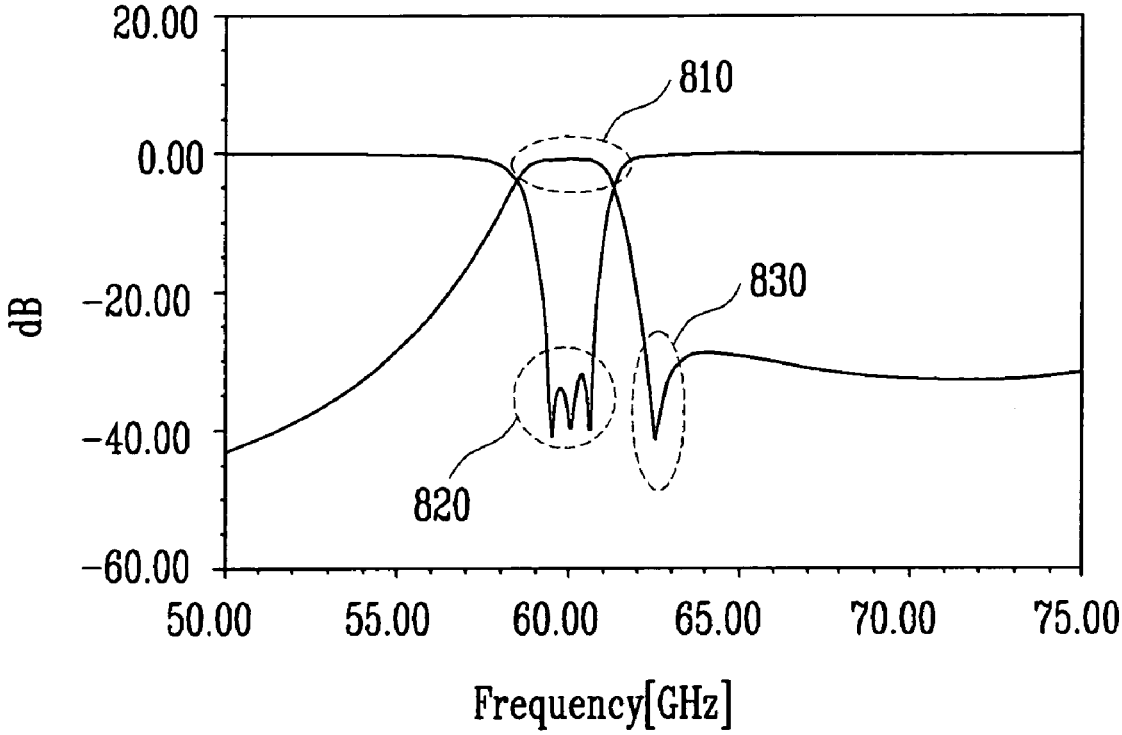
FIG. 6 is a graph illustrating performance of the dielectric waveguide filter of FIG. 3.

FIG. 6 is a graph illustrating performance of the dielectric waveguide filter of FIG. 3.

From FIG. 6, it can be appreciated that, in the inventive dielectric waveguide filter, a frequency range is 59.5 GHz to 60.5 GHz, a bandwidth is 1 GHz, and the attenuation pole for removing the image wave at the top of the pass band is formed. In FIG. 6, a frequency response characteristic can be obtained by the insertion loss 810, a reflection loss 820, and the top attenuation pole 830 formed by the cross-coupling.

Figure 7:
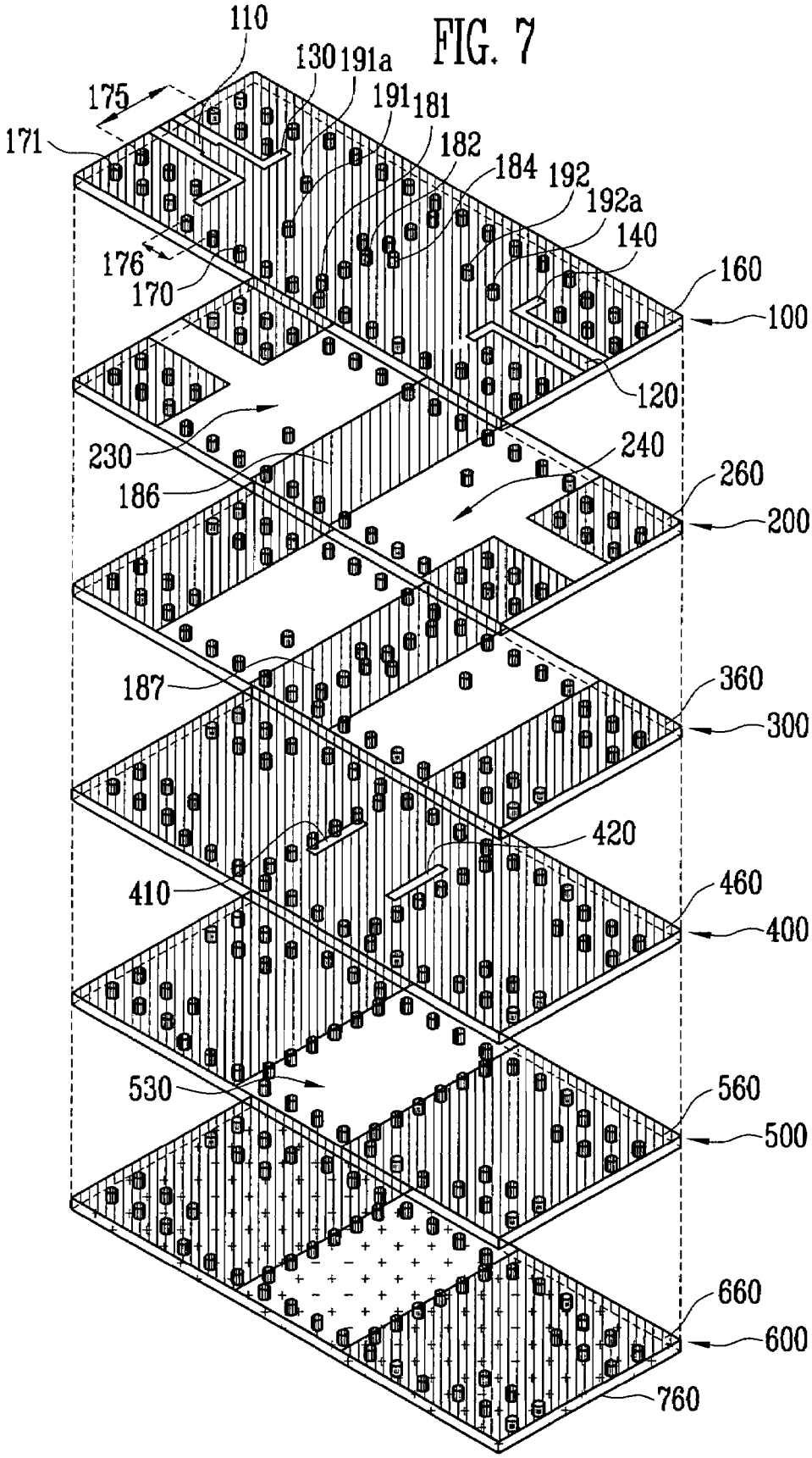
FIG. 7 illustrates the construction of a dielectric waveguide filter with cross-coupling according to the second embodiment of the present invention.

FIG. 7 illustrates the construction of a dielectric waveguide filter with cross-coupling according to a second embodiment of the present invention.

Referring to FIG. 7, the inventive dielectric waveguide filter includes a first ground plane 160 and a second ground plane 760 at its top and bottom, and a dielectric substrate with a multi-layered structure between the two ground planes 160 and 760. The dielectric waveguide filter further includes an input port 110 and an output port 120 for connecting with external systems and other devices; converters 130 and 140 for transiting a signal from a transverse electromagnetic (TEM) mode to a transverse electric $(TE)_{10}$ mode; dielectric waveguide resonators 230, 240, and 530 providing a desired characteristic of the filter; vias 170 for forming each of dielectric waveguide resonators 230, 240, and 530; vias 171 for removing an unwanted waveguide mode; vias 181, 182, and 184 for cross-coupling between the dielectric waveguide resonators 230 and 240 disposed on the same layer; patterns 186 and 187 for cross-coupling between the two dielectric waveguide resonators 230 and 240; vias 191, 191*a*, 192, and 192*a* for controlling each coupling between the input/output ports 110 and 120 and the two dielectric waveguide resonators 230 and 240; and patterns 410 and 420 (reference numeral 410 of FIG. 9D) for electric-field coupling between the dielectric waveguide resonators 230 and 530, and 240 and 530 disposed on different layers.

The inventive dielectric waveguide filter according to the second embodiment is substantially the same as the dielectric waveguide filter according to the first embodiment, excepting for the patterns 186 and 187 for cross-coupling between the two dielectric waveguide resonators 230 and 240 and a coupling relationship between the patterns and other constitutional components. The patterns 186 and 187 are preferable metallized patterns.

The patterns 186 and 187 are located on the same layer and at the boundary surface between the two dielectric waveguide resonators 230 and 240 that are not adjacent to each other (not electric-field coupled with each other). The patterns 186 and 187 control the cross-coupling between the two dielectric waveguide resonators 230 and 240. The patterns 186 and 187 function to form an attenuation pole for removing an image wave at top and bottom of a desired band, that is, a pass band.

Figure 8A:
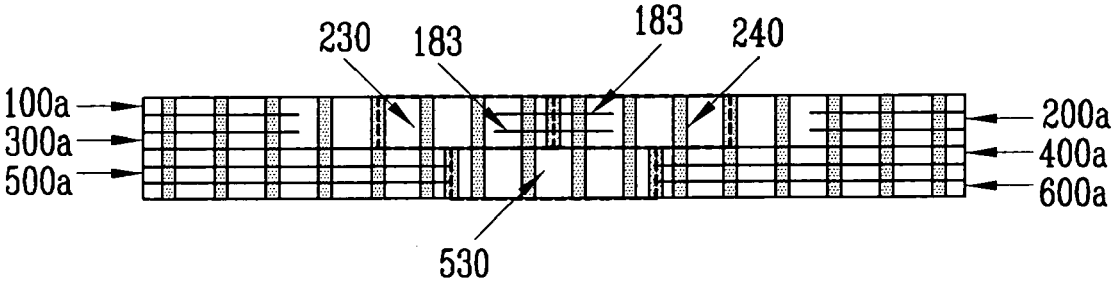
FIG. 8A is a front view illustrating the dielectric waveguide filter of FIG. 7.
Figure 8B:
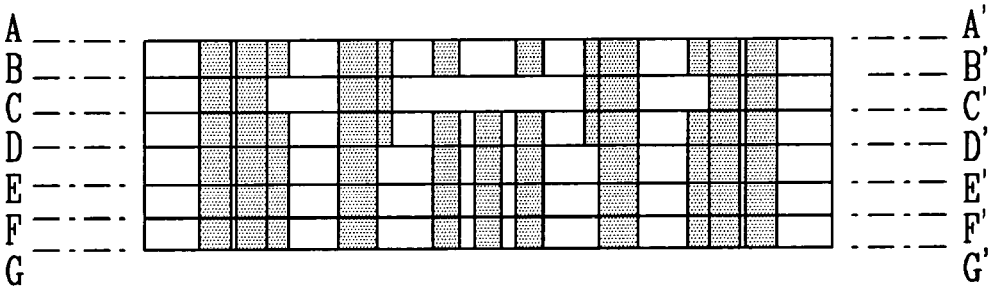
FIG. 8B is a side view illustrating the dielectric waveguide filter of FIG. 7.

As shown in FIGS. 8A and 8B, the dielectric waveguide filter includes the dielectric substrate having a six-layered structure. Each of the dielectric substrates 100*a*, 200*a*, 300*a*, 400*a*, 500*a*, and 600*a* having each layer A-A', B-B', C-C', D-D', E-E', F-F', and G-G' is manufactured only with the via having the same diameter and the simple pattern. Each dielectric substrate will be described as follows.

Figure 9A:
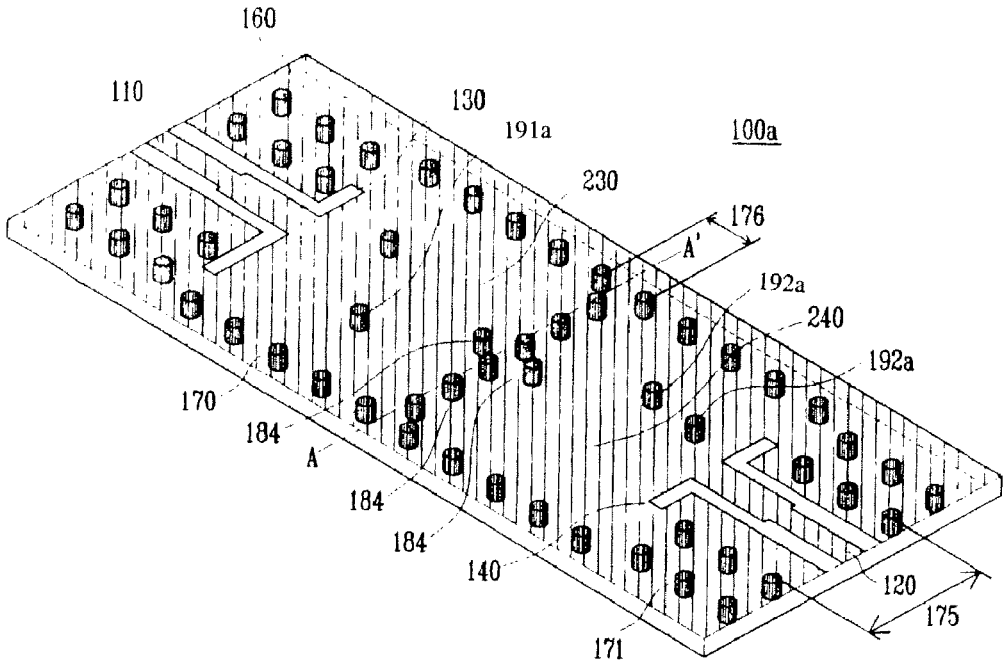
FIGS. 9A to 9F are perspective views illustrating respective layers of the dielectric waveguide filter of FIG. 7.

In comparison with the dielectric substrate having the A-A' layer in the dielectric waveguide filter according to the first embodiment of the present invention, the dielectric substrate 100*a* having the A-A' layer further includes vias 184 for cross-coupling between the two dielectric waveguide resonators 230 and 240, and vias 191*a* and 192*a* for coupling between the input/output ports 110 and 120 and the two dielectric waveguide resonators 230 and 240, as shown in FIG. 9A.

Figure 9B:
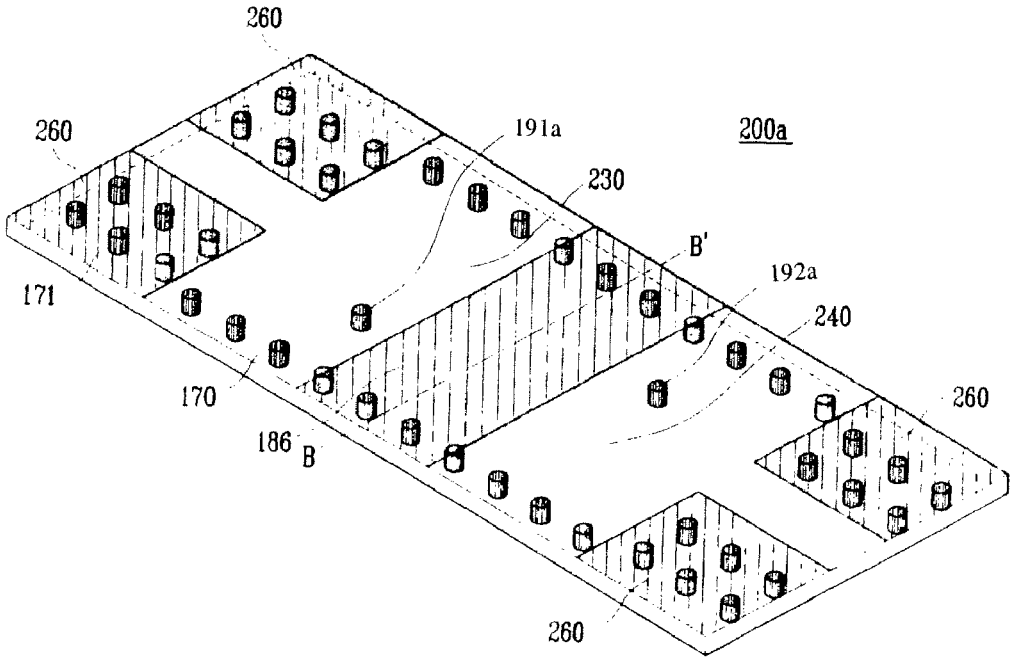

In comparison with the dielectric substrate having the B-B' layer according to the first embodiment of the present invention, the dielectric substrate 200*a* having the B-B' layer further includes a pattern 183 for cross-coupling between two dielectric waveguide resonators 230 and 240, as shown in FIG. 9B.

Figure 9C:
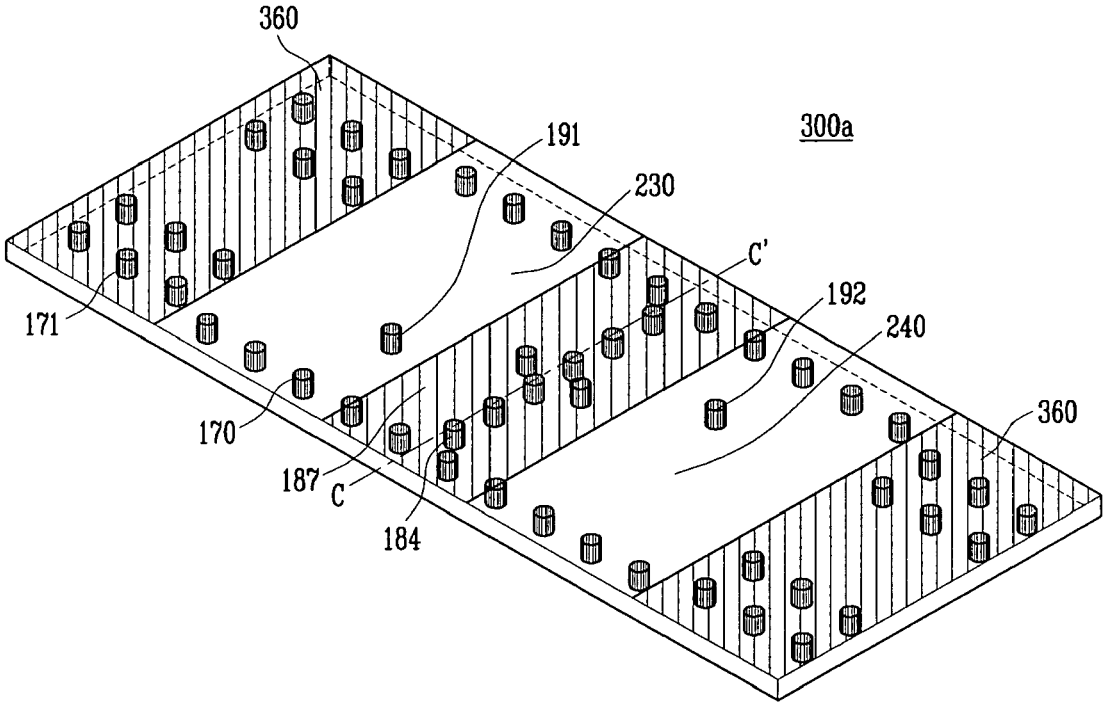

In comparison with the dielectric substrate having the C-C' layer according to the first embodiment of the present invention, the dielectric substrate 300*a* having the C-C' layer further includes another pattern 187 for cross-coupling between the two dielectric waveguide resonators 230 and 240, as shown in FIG. 9C.

Figure 9D:
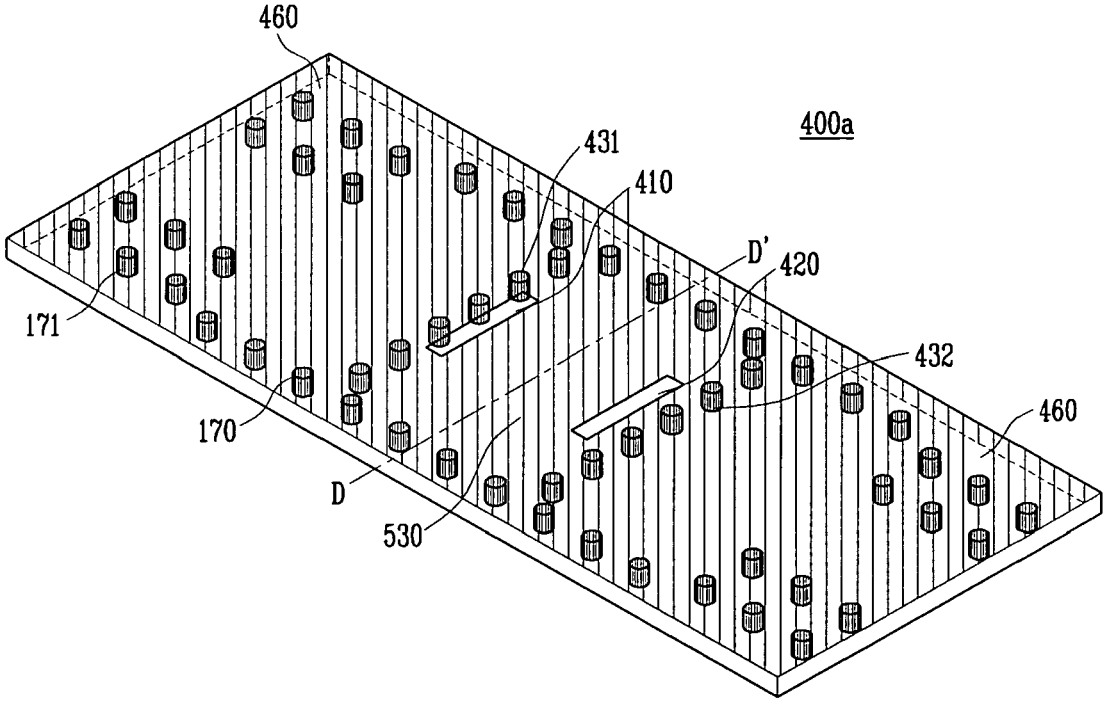
Figure 9E:
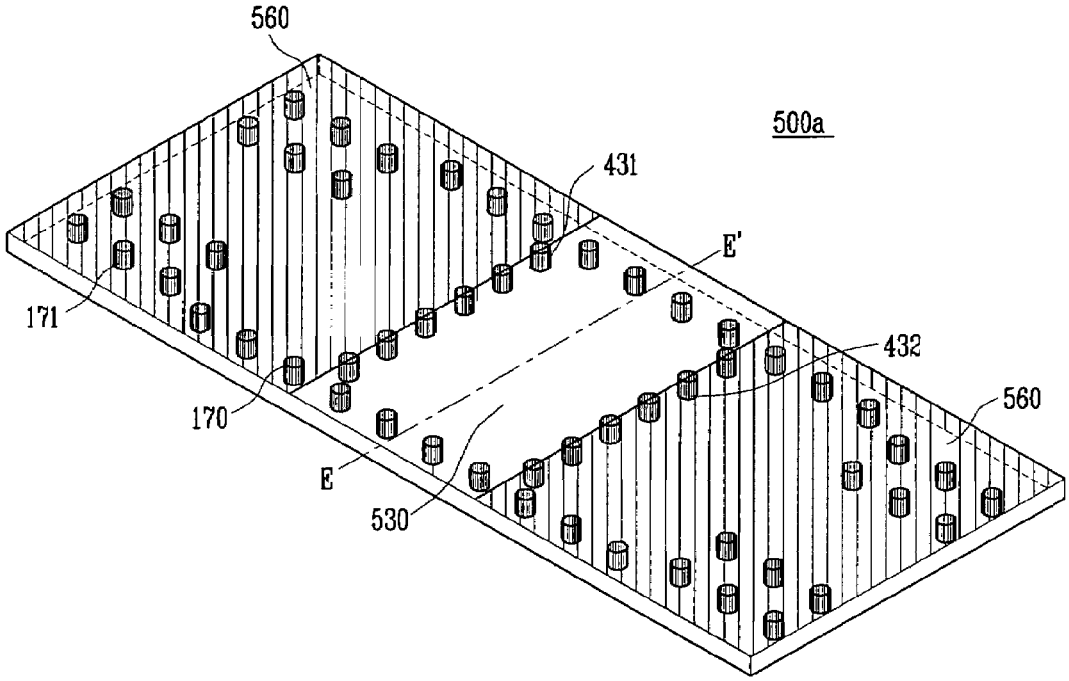
Figure 9F:
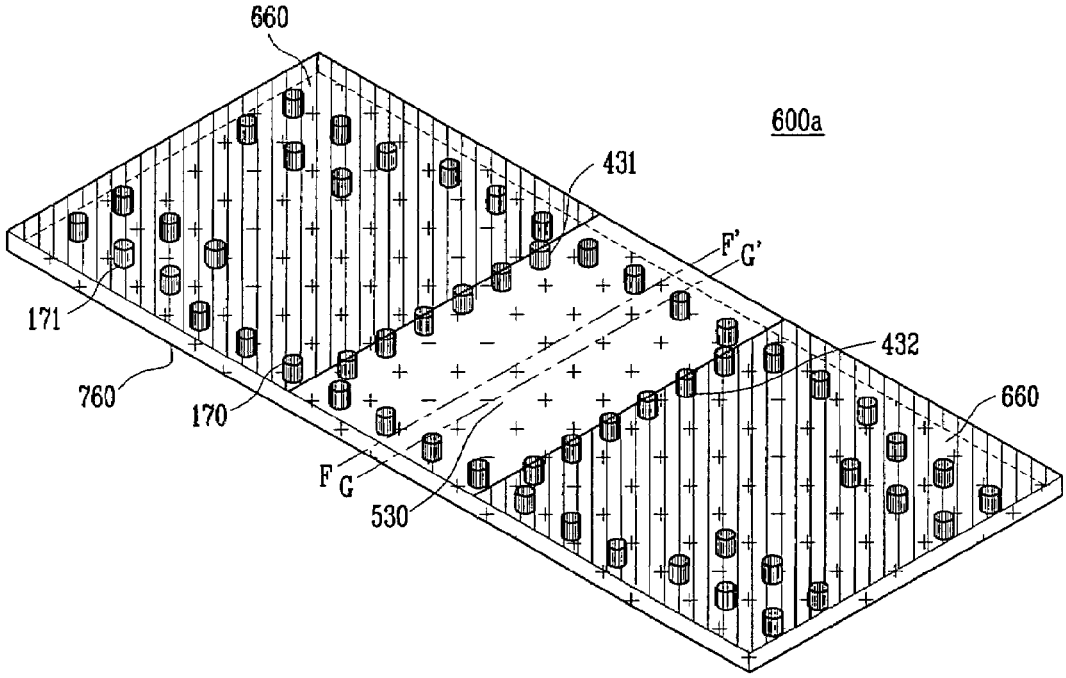

As shown in FIGS. 9D to 9F, the dielectric substrate 400*a* having the D-D' layer, the dielectric substrate 500*a* having the E-E' layer, and the dielectric substrate 600*a* having the F-F' layer and the G-G' layer are identical with the dielectric substrates having the D-D' layer, the E-E' layer, and the F-F' layer according to the first embodiment of the present invention, respectively.

Figure 10:
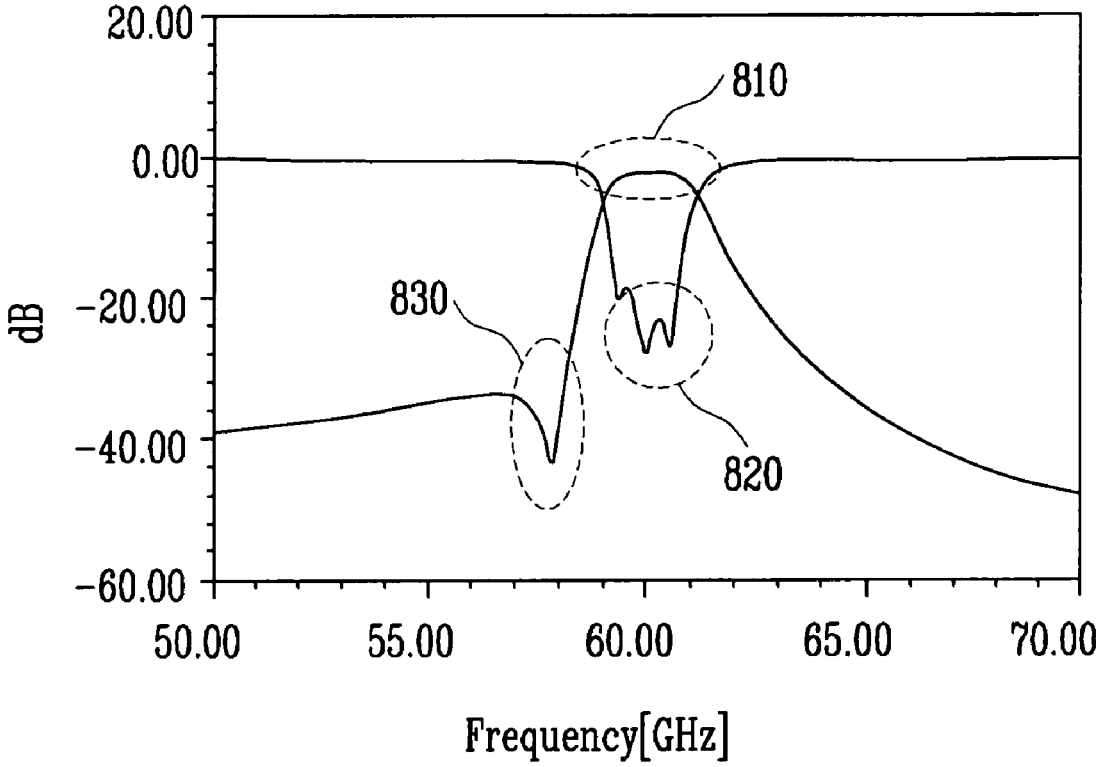
FIG. 10 is a graph illustrating performance of the dielectric waveguide filter of FIG. 7.

FIG. 10 is a graph illustrating performance of the dielectric waveguide filter of FIG. 7.

As shown in FIG. 10, in the inventive dielectric waveguide filter, a frequency range is 59.5 GHz to 60.5 GHz, a bandwidth is 1 GHz, and the attenuation pole for removing the image wave at the bottom of the pass band is formed. In FIG. 10, a frequency response characteristic can be obtained by an insertion loss 810*a*, a reflection loss 820*a*, and the bottom attenuation pole 830*c* formed by the cross-coupling.

As described above, in the dielectric waveguide filter structure according to the present invention, the dielectric waveguide resonators are disposed at the top and bottom of the dielectric multi-layered structure, the dielectric waveguide resonators adjacent to each other are arranged to be coupled using slots, and the dielectric waveguide resonators not adjacent to each other are arranged to be cross coupled with each other using the via and pattern structure, thereby forming the attenuation pole for removing the image wave at the top and bottom of the pass band, and effectively suppressing the radiation loss and the broadband spurious. Further, it has the property of cutting off the unwanted other waveguide modes by the via structure and the ground pattern disposed around the input/output ports.

Furthermore, by allowing the vias to have the same size within the dielectric waveguide filter and using a simple conductor pattern, a manufacture process can be simplified, and a yield can be enhanced in mass production. In addition, it is possible to provide the low-priced and small-sized dielectric waveguide filter capable of using the millimeter RF front-end module of the 60 GHz pico cell communication system.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A dielectric waveguide filter comprising:

a multi-layered structure of dielectric substrates having first and second ground planes at its top and bottom;

first, second, and third waveguide resonators disposed on multiple layers within the multi-layered structure;

converters for signal transition between input/output ports and the first and third waveguide resonators;

first vias for forming the first, second, and third waveguide resonators;

second vias disposed at a boundary surface of the first waveguide resonator and the third waveguide resonator; and a metallized pattern located at the boundary surface of the first and third waveguide resonators, wherein the second vias and the metallized pattern are arranged to control cross-coupling of the first and third waveguide resonators and to form an attenuation pole for removing an image wave at a top or bottom of a pass band.

2. The dielectric waveguide filter according to claim 1, wherein the first and second waveguide resonators and the second and third waveguide resonators are coupled using slots.

3. The dielectric waveguide filter according to claim 1, wherein some of the first vias connect the first ground plane with the second ground plane.

4. The dielectric waveguide filter according to claim 1, wherein the second vias are arranged to control cross-coupling of the first and second waveguide resonators and to form the attenuation pole for removing the image wave at the top of the pass band.

5. The dielectric waveguide filter according to claim 1, wherein the first and second vias have the same diameter.

6. The dielectric waveguide filter according to claim 1, wherein the converters transit the signal from a TEM (Transverse ElectroMagnetic) mode to a $TE_{10}$ (transverse electric) mode.

7. The dielectric waveguide filter according to claim 1, wherein the input/output ports comprise at least one transmission line of a microstrip line, a stripline, and a coplanar waveguide.

8. The dielectric waveguide filter according to claim 1, further comprising third vias for controlling coupling between the input/output ports and the first and third waveguide resonators.

9. The dielectric waveguide filter according to claim 1, further comprising other vias disposed around the input/output ports for cutting off other unwanted waveguide modes.

10. The dielectric waveguide filter according to claim 1, further comprising a ground pattern disposed around the input/output ports for cutting off unwanted other waveguide modes.

* * * * *